252-146 AU 166 EX

9/28/82 XR 4,351,673

United States Patent [19]

Lawson

[11] 4,351,673

[45] Sep. 28, 1982

[54] METHOD FOR REMOVING IRON SULFIDE SCALE FROM METAL SURFACES

[75] Inventor: Michael B. Lawson, Duncan, Okla.

[73] Assignee: Halliburton Company, Duncan, Okla.

[21] Appl. No.: 266,226

[22] Filed: May 22, 1981

[51] Int. Cl.[3] ..... C23G 1/08

[52] U.S. Cl. ..... 134/3; 134/41; 252/142; 252/146

[58] Field of Search ..... 134/3, 41; 252/8.55 B, 252/148, 149, 151, 142, 146; 562/594

[56] References Cited

U.S. PATENT DOCUMENTS

| | | | |
|---|---|---|---|
| 1,873,083 | 8/1932 | Walker | 252/8.55 B |
| 3,399,230 | 8/1968 | Campbell | 562/594 |
| 3,794,523 | 2/1974 | Thompson | 134/3 |
| 4,147,647 | 4/1979 | Rybacki | 252/8.55 B X |
| 4,220,550 | 9/1980 | Frenier et al. | 134/41 X |
| 4,276,185 | 6/1981 | Martin | 252/8.55 B X |
| 4,289,639 | 9/1981 | Buske | 134/41 X |

FOREIGN PATENT DOCUMENTS

| | | | |
|---|---|---|---|
| 53-2351 | 1/1978 | Japan | 134/41 |

*Primary Examiner*—Marc L. Caroff

*Attorney, Agent, or Firm*—Edward F. Sherer; Thomas R. Weaver; J. H. Tregoning

[57] ABSTRACT

A method of removing ferrous sulfide from ferrous metal surfaces comprising contacting the ferrous sulfide with an aqueous composition comprising an acid selected from the group consisting of maleic acid, maleic anhydride, and the alkali metal and ammonium salts of maleic acid.

10 Claims, No Drawings

METHOD FOR REMOVING IRON SULFIDE SCALE FROM METAL SURFACES

This invention relates to a method of removing ferrous sulfide deposits from ferrous metal surfaces, and more particularly to a method for removing such deposits with a compound whereby the presence of free hydrogen sulfide is substantially minimized.

In many processes involving sulfur, deposits including ferrous sulfide (FeS) tend to build upon ferrous metal surfaces such as reactor walls, piping, and other surfaces. Petroleum refineries, which process crude oil or natural gas, end up with substantial amounts of ferrous sulfide on the metal surfaces in contact with the crude oil or gas. The scale must be periodically removed from the metal surfaces in order to restore efficient heat transfer, prevent burn outs due to hot spot development, and reduce restriction of the flow of fluid through the scale-blocked apparatus.

Numerous techniques have been proposed previously to affect the removal of ferrous sulfide. One method of removing ferrous sulfide comprises contacting the ferrous sulfide with a conventional acid cleaning solution. The acid cleaning solution reacts with the ferrous sulfide and produces gaseous hydrogen sulfide ($H_2S$).

Hydrogen sulfide gas produced during the acid cleaning of the surface containing the ferrous sulfide has several problems. First, hydrogen sulfide is an extremely toxic gas and cannot be vented to the atmosphere. In addition, hydrogen sulfide and acid cleaning solutions containing hydrogen sulfide can cause severe corrosion problems on ferrous metals.

In an effort to avoid the problem associated with the cleaning of ferrous sulfide with an acid, inhibiting compositions of various types have been added to the acid cleaning solutions which react with the hydrogen sulfide and thus prevent the release of the hydrogen sulfide to the atmosphere. One problem associated with this method of control of hydrogen sulfide generation is that many times precipitates form in the cleaning solution and are deposited on the surfaces which are being cleaned.

In another method of cleaning ferrous sulfide scale from metal surfaces, a chelating agent is added to the cleaning solution at a pH such that the hydrogen sulfide is not released to the atmosphere but is retained in the solution as sulfide or bisulfide ions. A major problem associated with this method of cleaning ferrous sulfide scales is that high temperatures are required for the effective operation of the chelating agent and the chelating agents are very expensive.

The present invention provides a method of removing ferrous sulfide deposits from ferrous metal surfaces which overcomes or at least mitigates the above described problems.

It has been discovered that ferrous sulfide can be removed from ferrous metal surfaces by contacting the surface with maleic acid and by this method the amount of hydrogen sulfide evolved in the reaction is greatly diminished with the result that the ferrous sulfide is removed from the metallic surface with a minimum amount of hydrogen sulfide gas evolution.

The present invention is a method for effectively removing ferrous sulfide scale from ferrous metal surfaces. The compound utilized in practicing the method can be broadly described as an aqueous solution comprising maleic acid. Optionally, an acid corrosion inhibitor may be added to the above described composition.

The process of the invention can be broadly described as comprising contacting the ferrous sulfide scale with the described aqueous solution at a temperature of from about ambient temperature to about 200° F. for a period of 6 to 12 hours.

As will be apparent from this broad description, the composition used in the invention is relatively simple in constitution and is easily formulated. Moreover, the ferrous sulfide removal method proposed is operative over a wide range of temperature and time conditions, rendering it flexible and effective under a variety of cleaning conditions which may, for example, shorten the downtime of the equipment.

As a final aspect indicative of the value and utility of the present invention, the spent ferrous sulfide scale removal solution can be easily removed from vessels in which it has been used, and can be treated after removal to render disposal of waste affluence a simple, economic, and ecologically satisfactory procedure.

Having broadly alluded to the method of the invention, and cited certain salient characteristics of the composition used in the method, the subsequent description herein will be directed to a consideration of certain preferred embodiments of the invention, into a detailed description of these embodiments in conjunction with examples set forth as illustrative of typical practice of the invention and utilizing certain preferred embodiments of the invention. As has been previously stated, the active or effective component of the composition used in the invention is maleic acid.

The acids that may be employed to carry out the invention are maleic acid, the di- and monoalkali metal salts of maleic acid and di and mono ammonium salts of maleic acid. In addition, the anhydrous form of maleic acid may readily be used in place of the acid form and is properly referred to as maleic anhydride. The preferred acid is maleic acid.

The amount of acid or acid salt used to carry out the method of the invention will vary greatly, depending upon the equipment and surface to be cleaned, but will vary over a wide range. Aqueous solutions which contain as little as 0.01 percent by weight of the acid are effective in removing the ferrous sulfide scale under some temperature conditions. The maximum amount of the acid which may be included in the aqueous solution is limited only by economics and by the solubility of the selected acid or salt in water. In general, the most effective and preferred concentration range of the acid material in the aqueous solution is from about 1 weight percent to about 35 weight percent. When the acid employed is maleic acid, a concentration of from about 1 to about 10 weight percent has been found to be the most effective concentration. In this range, the cleaning solution used to carry out the method of the invention has an excellent ferrous sulfide dissolution capability and prevents the evolution of significant quantities of hydrogen sulfide gas.

In addition to the acid component of the composition, the composition preferably contains a small amount of corrosion inhibiting compound. This compound functions, in the course of the cleaning procedure, to protect the metal surface from direct attack by the cleaning composition. In some occasional metal cleaning operations, the removal of small amounts of metal from the surface being cleaned is not intolerable, but this is generally not the case, and, in general, about 0.1 weight percent or more corrosion inhibiting compound is included in the composition. An amount of 0.1 percent has usually been found to be sufficient to attain maximum corrosion inhibition. It is particularly important that the inhibitor be included when the scale removal is carried out at relatively high temperature, i.e., above 175° F. Typical corrosion inhibiting compounds which can be effectively employed in the compositions of the invention include, but are not limited to alkyl pyridines, quaternary amine salts, and dibutylthiourea, and mixtures of these materials with each other and/or with carrier or surface active materials such as ethoxylated fatty amines. The preferred inhibitor is a mixture of N,N'-dibutylthiourea, ethylene oxide derivative of a fatty acid amine, alkyl pyridine, acetic acid, and ethylene glycol.

Although the type of water used in the aqueous solution containing the active materials described above is not critical to the practice of the invention, there are many applications of the process of the invention which make it desirable on such occasions to use potable water or water which is as nearly salt free as possible such as demineralized water.

The method of the invention is carried out first by preparing the composition of the invention. The composition is prepared by adding the acid or acid salt to an aqueous solution while agitating the aqueous solution. The corrosion inhibitor, if so desired, is then added to the composition. The pH is checked and adjusted to insure the pH is less than 7. The composition can be prepared in any convenient mixing apparatus.

The unit to be cleaned is next contacted by the composition of the invention. During the cleaning, temperatures in the range of about ambient temperature to about 200° F. have been found to be the most satisfactory, but the treatment can be carried out outside this range. The most preferred temperature for carrying out the method of the invention is about 150° F.

Many times the temperature in which contact of the composition of the invention with the ferrous sulfide is initially carried out will be determined by the temperature at which the vessel or other structure has been operated prior to treatment. Thus, where a vessel has been on stream, and it is desired to shut the vessel down and clean it with a minimum of time, the vessel will initially be cooled down to a temperature in the upper portion of the temperature range specified. On the other hand, where a vessel or other equipment has been off stream, or has operated under relatively cool or ambient temperature conditions, the method can be carried out at the lower portion of the operative temperature range specified. The time of treatment should be sufficient to remove substantially all the scale from the vessel or metal surface and, therefore, the time that the composition must contact the vessel or the surface will depend on the nature and the thickness of the scale and the temperature the treatment is carried out.

When the metal to be cleaned has been brought to the appropriate temperature, the composition of the invention is then introduced into the vessel or into contact with the ferrous sulfide encrusted surface. The solution is then preferably slowly circulated with pumps so that efficient contact is maintained between the composition of the invention and the ferrous sulfide to be removed. From time to time, additional amounts of the cleaning composition can be added to the original quantity placed within the vessel or in contact with the metal so that the capacity of the composition of the invention is ultimately sufficient to accomplish this objective.

The time period over which contact is maintained between the composition of the invention and the ferrous sulfide bearing metal can vary widely. Usually, a contact time of at least one hour will be needed. The operative time periods which have been found preferable in most usages range from about 6 to about 12 hours. There appears to be no critical limitation on the maximum amount of time that the scale removing composition is in contact with the ferrous sulfide encrusted metal except that time considerations are, of course, very important in many applications of the invention, since extended downtime on boilers and other heat exchange equipment is directly corollative to an economic loss attributed such downtime and inoperativeness. It has been found most desirable to maintain contact between the composition and the metal to be cleaned for a period of from about 4 hours to about 8 hours.

The amount and type of corrosion inhibitor which, if desired, is included in the composition is dependent upon the temperature at which the process is carried out with higher temperatures generally requiring the inclusion of a relatively large amount of corrosion inhibitor.

With respect to the pressure at which the cleaning method of the invention is carried out, the pressure is in no way critical to the operativeness of the process.

After the completion of the total contact time for the purpose of removing the ferrous sulfide scale from the metallic surface, the vessel or other structure being cleaned is cooled down to at least 100° F., and preferably ambient temperature, and the spent cleaning composition is then drained from the vessel or removed from contact with the metallic structure. The structure is rinsed with water. The spent composition of the invention is then disposed.

The following examples will serve to more comprehensively illustrate the principals of the invention but in being directed to certain specific compounds and process steps and conditions, are not intended to limit the bounds of the invention.

EXAMPLE I

Solvents were prepared with technical grade ferrous sulfide in the test apparatus described below, for the purpose of determining the weight percent of ferrous sulfide consumed by the solvent and the quantity of hydrogen sulfide that was actually escaping from the reaction of the solvent on the ferrous sulfide.

The test apparatus consisted of a 250 ml. glass reaction bottle, a 250 ml. flask and a scrubbing flask. The reaction bottles contained 100 ml. of solvent into which various amounts of the additive material were dissolved. Two grams of technical grade ferrous sulfide were placed in their reaction flask. The emitted hydrogen sulfide passed from the reaction bottle through the empty flask and into the scrubbing flask. The ferrous sulfide, prior to use in the experiment, had been passed through wire screens to obtain a particle size distribution of about 13 to about 20 mesh. The scrubbing flasks were analyzed for sulfur after a specified reaction time and the hydrogen sulfide which passed into the scrubbing flask was reported as ppm. of sulfur in the following table. Standard analytical procedures were used to determine the ppm. of sulfur. The reaction bottle was fitted with a magnetic stirring bar, a thermometer, and a gas outlet. The reaction was carried out at 150° F. for a period of 1 hour. The results of these tests are set forth in Table I.

TABLE I

| Test No. | Composition | $S^{=}$ in Scrubber (ppm) | % FeS Dissolved |
|---|---|---|---|
| 1 | 10.005 g maleic acid | 136 | 78 |
| 2 | 11.508 g $NaHSO_4.H_2O$ | 1535 | 92 |

From the above data it can be seen that a considerable solvent improvement is obtained using the composition of the invention. The solvents using maleic acid for dissolving the ferrous sulfide had excellent results in ferrous sulfide dissolution and minimized the formation of hydrogen sulfide gas which is normally formed during the ferrous sulfide removal process.

EXAMPLE II

Several compositions of the invention were prepared using maleic acid and maleic acid containing an inhibitor in order to compare the ferrous sulfide dissolution and hydrogen sulfide scrubbing of the two compositions. In addition, the corrosion rates of the two compositions were compared. The tests were carried out in the same apparatus as described in Example I. In addition, AISI 1020 mild steel corrosion coupons were prepared and placed in each composition and corrosion tests were conducted by NACE Standard TM-01-69. The inhibitor used to carry out this experiment was N, N'-dilbutylthiourea, ethylene oxide derivative of fatty acid amine, alkyl pyridine, acetic acid and ethylene glycol. The results of these tests are reported in Table II.

TABLE II

Corrosion Rates of 10 wt % Maleic Acid on 1020 Mild Steel in the Presence of FeS at 150° F. and 200° F.

| Test No. | Temperature (°F.) | Inhibitor | % FeS Dissolved | Sulfur evolved (ppm) | Corrosion Rate ($lb/ft^2/day$) |
|---|---|---|---|---|---|
| 1 | 150 | 0 | 76 | 2980 | .342 |
| 2 | 150 | 0.1 | 64 | 78 | .0011 |
| 3 | 200 | 0 | 76 | 3480 | .533 |
| 4 | 200 | 0.1 | 95 | 2310 | .049 |

From the results of the tests, it can be seen that the evolution of hydrogen sulfide decreased using an inhibitor and excellent results were achieved in ferrous sulfide dissolution.

It is believed that the evolution of hydrogen sulfide gas is prevented by a reaction of the sulfide with the maleic acid to form thiodisuccinic acid and it is, therefore, believed that two moles of maleic acid are required to dissolve the ferrous sulfide. The amount of the composition of the invention which should be employed in carrying out the process of the invention is, however, not susceptible to precise definitions since the amount of ferrous sulfide will vary from one cleaning job to another. Moreover, in no case is it possible to precisely, or even more than approximately, calculate or estimate the amount of ferrous sulfide which may be present on a given metallic surface which is to be cleaned. It can be stated, however, that there must be present a sufficient amount of the composition that considering the concentration of the ferrous sulfide material therein, there is a sufficient amount of the latter material to combine stoichiometrically with the amount of ferrous sulfide which is present and which is to be removed. The use of amounts of the composition in excess of the stoichiometric amounts described is not harmful to the operation of the invention, except when a point is reached at which the dissolved ferrous sulfide within the composition unsuitably limits the carrying capacity of the composition. This limitation is generally encountered, however, only at a point where the economic considerations have already dictated a limitation to the amount of the composition employed. It has been found that the reaction between the ferrous sulfide and the composition of the invention can be chemically monitored, wherein the presence or absence of the ferrous sulfide is measured.

Although certain preferred embodiments of the invention have been herein described for illustrative purposes, it will be appreciated that various modifications and innovations of the procedures and compositions recited may be effected without departure from the basic principals which underlie the invention. Changes of this type are therefore deemed to lie within the spirit and scope of the invention except as may be necessarily limited by the amended claims or reasonable equivalents thereof.

What is claimed is:

1. A process for dissolving ferrous sulfide with minimum evolution of hydrogen sulfide gas comprising contacting said ferrous sulfide with an aqueous acidic solution containing a compound in an amount effective to dissolve ferrous sulfide, said compound selected from the group consisting of maleic acid, maleic anhydride, alkali metal and ammonium salts of maleic acid and mixtures thereof, said aqueous solution having a pH of less than 7, and maintaining said contact for a time and at a temperature sufficient to dissolve said ferrous sulfide.

2. The process of claim 1 wherein said compound is present in said aqueous acidic solution in an amount in the range of from about 1 to about 35 percent by weight of said solution.

3. The process of claim 2 wherein said contacting temperature is in the range of from about ambient to about 200° F. and said contacting time is in the range of from about 1 to about 12 hours.

4 The process of claim 3 wherein said aqueous acidic solution is further characterized to include an effective amount of a suitable corrosion inhibitor.

5. The process of claim 4 wherein said ferrous sulfide is a deposit on a ferrous metal surface.

6. The process of claim 1 wherein said compound is maleic acid.

7. The process of claim 6 wherein said maleic acid is present in said aqueous acidic solution in an amount in the range of from about 1 to about 10 percent by weight of said solution.

8. The process of claim 7 wherein said contacting temperature is in the range of from about 140° F. to about 160° F. and said contacting time is in the range of from about 4 to about 8 hours.

9. The process of claim 8 wherein said aqueous acidic solution is further characterized to include an effective amount of a suitable corrosion inhibitor.

10. The process of claim 9 wherein said ferrous sulfide is a deposit on a ferrous metal surface.

* * * * *

UNITED STATES PATENT AND TRADEMARK OFFICE

CERTIFICATE OF CORRECTION

PATENT NO. : 4,351,673

DATED : September 28, 1982

INVENTOR(S) : Michael B. Lawson

It is certified that error appears in the above-identified patent and that said Letters Patent is hereby corrected as shown below:

Column 5, at line 10, on Test No. 2, under "Composition", the composition "11.508 g $NaHSO_4.H_2O$" should read:

"11.508 g $NaHSO_4 \cdot H_2O$"

Column 5, at line 31, the word "N, N'-dilbutylthiourea" should read:

"N, N'dibutylthiourea".

Signed and Sealed this

Second Day of October 1984

[SEAL]

*Attest:*

GERALD J. MOSSINGHOFF

*Attesting Officer*

*Commissioner of Patents and Trademarks*